United States Patent [19]

Cripe

[11] 3,941,247

[45] Mar. 2, 1976

[54] MODULAR DISPLAY MEANS

[76] Inventor: Robert W. Cripe, 339 E. Floral Ave., Arcadia, Calif. 91006

[22] Filed: Apr. 18, 1974

[21] Appl. No.: 461,926

[52] U.S. Cl. ..... 206/511; 220/72

[51] Int. Cl.[2] ..... B65D 21/02

[58] Field of Search ..... 206/503, 504, 509–512; 220/23.4, 23.6, 72; 211/126, 133; 248/127, 146, 152, 174, 176, 346; 52/593, 595, 603; 46/24, 25, 26

[56] References Cited

UNITED STATES PATENTS

| | | | |
|---|---|---|---|
| 1,881,224 | 10/1932 | Nuckols | 248/174 |
| 2,036,276 | 4/1936 | Hothersall | 220/72 |
| 2,483,269 | 9/1949 | Fender | 220/72 X |
| 2,487,584 | 11/1949 | Patterson | 206/503 X |
| 2,625,290 | 1/1953 | Kice et al. | 220/72 X |
| 3,103,278 | 9/1963 | Kuzma et al. | 206/511 X |
| 3,154,197 | 10/1964 | Tweed | 206/509 X |
| 3,191,796 | 6/1965 | Schwartz et al. | 220/23.6 |
| 3,406,855 | 10/1968 | McKechnie | 220/72 X |

*Primary Examiner*—William Price
*Assistant Examiner*—Stephen Marcus
*Attorney, Agent, or Firm*—Poms, Smith, Lande & Glenny

[57] ABSTRACT

A lightweight preformed environment resistant display block adapted to provide a display means of a plurality of like modular display blocks for exhibiting various articles in a number of different display arrangements. A modular display block of integral homogeneous polyhedral hollow form including side walls, a bottom wall, and a top wall located below top edges of the side walls to provide a pocket or cavity for holding displayed articles. Means are provided on said bottom wall and on edges of said side walls for interlocking modular display blocks in a number of different display arrangements.

2 Claims, 8 Drawing Figures

MODULAR DISPLAY MEANS

BACKGROUND OF INVENTION

In present modern supermarket display of merchandise and products, it is often desired to display lead items, sale items, or other market leaders in locations other than the normal arrangement of horizontal shelving. Some examples of such locations are at ends of a shelf row, areas adjacent checkout stands, areas adjacent entrance doors, and other suitable locations within a store or supermarket for drawing the attention of the customers to the particular displayed products.

Heretofore, such displays were provided by employing a carpenter to erect and construct a display frame which would be covered with paper covering and which might be attractively decorated by colored crepe paper or other colored paper. The costs involved in constructing a display frame were considerable in terms of labor and time. In other prior instances, such display stands or racks were provided by utilizing shipping crates or boxes which had contained a product to be sold, arranging the crates or boxes in a desired configuration and then decorating the arrangement of boxes with suitable material such colored crepe or paper. Such prior proposed displays were based upon the ingenuity of the local store manager. The quality and attractiveness of such displays would vary from store to store even within a supermarket chain, and even within a single store depending upon scrap material available. The erection and installation of such display stands was haphazard, the materials used were usually not strong and adapted to withstand the continual abuse of customers and of maintenance personnel, and tended to become dirty, mutilated and unsightly after a relatively short time. Such displays were obviously not adapted for repetitive use.

SUMMARY OF INVENTION

The present invention relates to a modular display means for use in supermarket stores for the attractive, clean display of various types of articles and products in a number of different display arrangements. The present invention contemplates a modular display means based upon a lightweight sturdy, strong, environment resistant modular display block which is designed and arranged to be inexpensive to manufacture and to be assembled with like display blocks rapidly and to provide an attractive display base for products or articles to be displayed. The invention contemplates such a modular display arrangement which is inexpensive to manufacture, which is inexpensive to install and to disassemble, and which is adapted for repetitive use without deterioration of its attractiveness and utility.

The main object of the present invention is to provide a modular display block for use in special displays of articles to be sold.

An object of the present invention is to provide a modular display block which is lightweight, of suitable plastic material, and may be provided in a number of different attractive colors for assembly in an attractive display stand.

Another object of the invention is to provide a modular display means in which the display blocks or display elements are provided with relatively hard, smooth surfaces resistant to mutilation, scratching and marring during normal use and which are soil resistant and readily cleaned.

A further object of the present invention is to provide a modular display block wherein one of the faces of said block is provided with a pocket or cavity for containing articles being displayed.

A still further object of the present invention is to disclose and provide a modular display block which one of its walls is generally planar to provide a flat surface for supporting articles to be displayed.

A still further object of the present invention is to provide a modular display block having means on opposite faces of each block for interlocking with means provided on like surfaces of a similar modeled modular block so that a plurality of such display blocks may be arranged in vertical stacked relation, in staircase relation, or in lateral offset pyramid type relation.

Various other objects and advantages of the present invention will be readily apparent from the following description of the drawings in which an exemplary embodiment of the invention is shown.

IN THE DRAWINGS

FIG. 5 being a perspective view of three display blocks arranged in step or staircase fashion.

FIG. 6 shows an arrangement of seven display blocks in another form of stepped arrangement.

FIG. 7 shows seven display blocks in still another arrangement.

FIG. 8 shows eight display blocks arranged in vertical stacks of two blocks.

Figure 1:
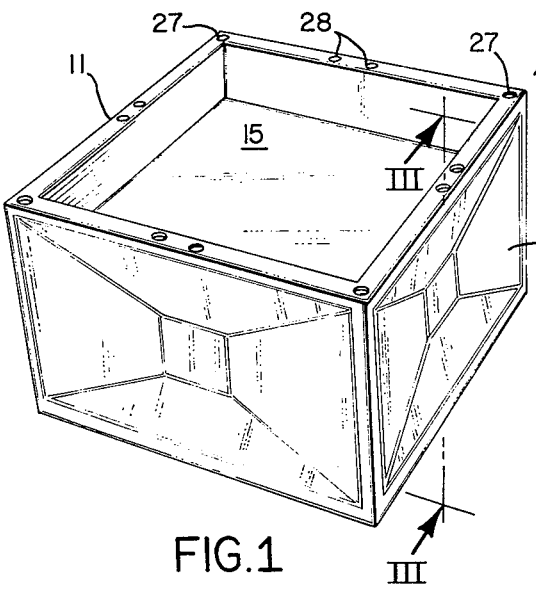
FIG. 1 is a top perspective view of a display block embodying this invention.
Figure 2:
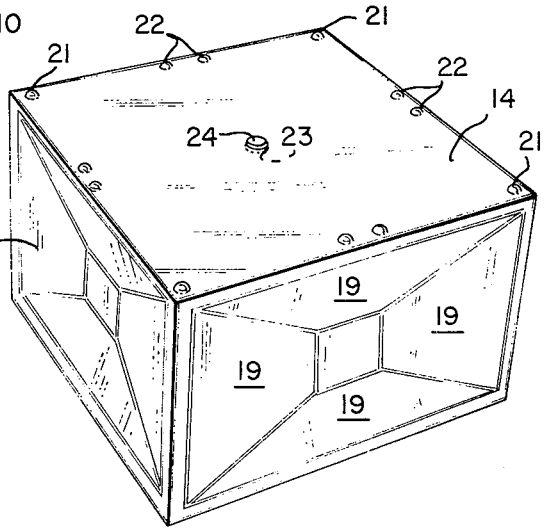
FIG. 2 is a perspective view of the display block shown in FIG. 1 turned up-side-down to view the bottom wall thereof.
Figure 4:
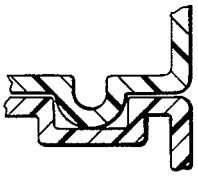
FIG. 4 is a fragmentary enlarged sectional view taken in the plane indicated by line IV—IV of FIG. 5.
Figure 3:
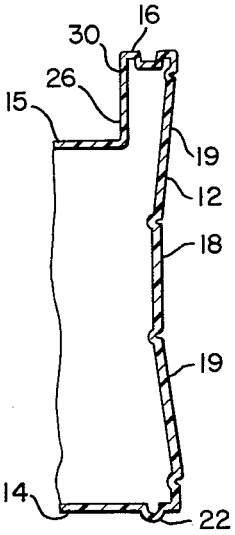
FIG. 3 is a fragmentary enlarged sectional view taken in the vertical plane indicated by line III—III of FIG. 1.

The modular display block generally indicated at 10 in FIG. 1 comprises a block body 11 having side walls 12, a bottom wall 14, and a top wall 15 recessed below the top edge 16 of side walls 12. Each side wall 12 is slightly recessed or dished inwardly of the block body and forms a central polygonal wall portion 18 and trapezoidal wall portions 19 flaring outwardly therefrom to the peripheral edges of the wall 12.

Bottom wall 14 is generally planar. At each corner of bottom wall 14 is integrally formed a projection 21 and between the each pair of corner projections 21 and adjacent and on opposite sides of a midplane passing through the block body 11 may be formed projections 22. A vent opening 23 is provided in the center of bottom wall 14 for venting gases formed during molding of the block body, vent opening 23 being normally closed by a suitable plug 24.

Top wall 15 is recessed below the plane of the edges of side walls 12 a selected distance which may be approximately ¼ the height of side wall 12. In the exemplary block body illustrated herein, the height of side walls 12 may be 16 inches and the depth of the pocket 26 provided by recessed top wall 15 may be approximately 4 inches. The length of each side wall 12 may be approximately 22 inches. Recessed top wall 15 provides a double walled structure adjacent the top of the block body and the top edges 16 are formed of a suitable width so that an indentation or hole 27 may be formed in each corner thereof for reception of the projections 21. Between the holes 27 may be provided indentations or holes 28 on opposite sides of a plane bisecting the block body to cooperate with projections 22. The recessed top wall 15 provided by recess wall 30 provides a structurally strong section of material about the top portion of the display box in a configuration of a relatively deep walled inverted channel section defined by recess wall 30, top edge 16 and the wall portions 19.

Block body 11 is formed by rotary type molding and the walls of the block body are integral and may be approximately ¼ of an inch thick. Preferably, the material of the block body is one which will not distort under conditions of heat and under conditions where the block body is subjected to heavy loads for long periods of time. The material is impervious and presents a hard, smooth surface which does not attract or accumulate dust and dirt and which when soiled may be readily cleaned by wiping with a damp cloth. A suitable preferred material for the block body is a cross linked polyurethane material made by Phillips and identified by No. CL 100 In rotational molding of the block body the raw polyurethane material in the form of a powder is placed within the mold. The mold is then rotated in a heated atmosphere so that the powdered material is melted and deposited on walls of the mold by the rotational forces acting upon the molten material within the mold. After the mold has been cooled and subjected to a water bath, a port is made in the bottom wall to permit the escape of gases produced during the molding operation. The block body is then permitted to cool and after cooling the vent opening may be plugged.

The block body which results from such rotational molding is characterized by a wall section thickness which is uniform throughout the block body. The slight concavity of the four side walls together with the deep inverted channel section around the top periphery of the block provides a polyhedral preformed sturdy block body adapted to carry loads of up to 600 pounds or more without distortion or collapse. The dimensional stability of the block body permits the bodies to be arranged in a variety of different display patterns.

Figure 5:
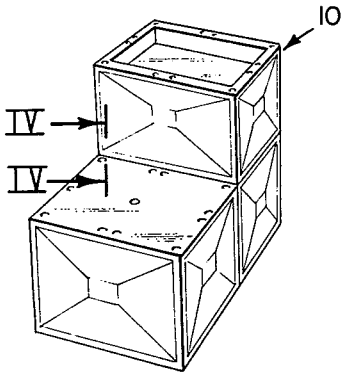
FIGS. 5, 6, 7 and 8 illustrate the display block of FIG. 1 arranged with a plurality of like blocks in order to provide various display arrangements.

In FIG. 5 a simple display of three display blocks is shown, the rear two blocks being stacked with the top walls in upper position to provide interlocking therebetween by the cooperation of the projections 21 and 22 with their respective holes or recesses 27, 28. In FIG. 5 the uppermost box has the display pocket 26 facing upwardly to receive and contain products to be displayed. In front of the two stacked blocks may be a single display block with the bottom wall 14 uppermost. Either the bottom wall 14 or the top wall 15 may be placed uppermost in the display of FIG. 5 depending upon the type of product to be displayed.

Figure 6:
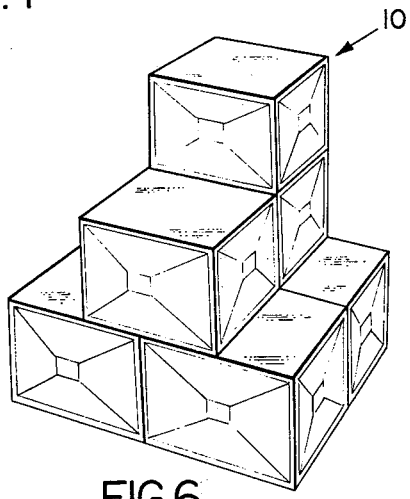

In FIG. 6 a partial pyramid type of display is illustrated in which four display blocks with bottom walls facing upwardly provide a base for three display blocks arranged on top thereof in a staircase or stepped fashion. In FIG. 6 all of the display blocks have bottom walls uppermost depending upon the product displayed. Each of the blocks in FIG. 6 could be reversed in position so that the top wall was uppermost if so desired.

Figure 7:
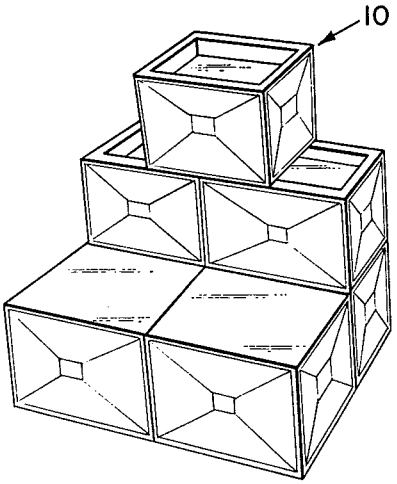

FIG. 7 shows still another arrangement of display blocks in which two stacks of blocks are arranged at the rear of two front blocks placed with their bottom walls uppermost. The upper boxes of the stacks of two may have their top walls uppermost to provide pockets for containing products displayed. On top of the two uppermost rear blocks a third block may be positioned by means of the interlocking projections and holes described above. The upper display block spans the joint between the two supporting blocks and it will be noted that the corner projections 21 of the upper block will engage one of the intermediate holes 28 of the supporting block.

Figure 8:
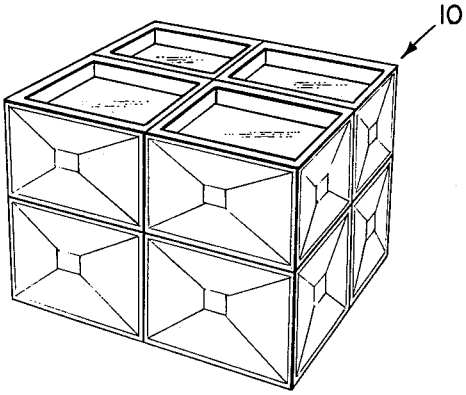

FIG. 8 shows a display arrangement wherein sets of two vertically stacked blocks are placed together to provide four product display pockets 26 in close adjacent relation.

The type of product displayed on the display block 10 of this invention may be any type of product adapted by size and weight for display in a pocket such as 26 or on a surface such as provided by bottom wall 14. The display blocks are of relatively light weight and may be readily assembled and disassembled and transported to different locations within a store for the erection of a modular display. The use of a plastic material provides the opportunity for selecting materials of widely different colors which can be attractively combined in a colorful display. The inclusion of colors in the material of the display block makes unnecessary the addition of colored paper or other decorative trimmings normally used in such displays.

It will be understood that various changes and modifications will be made in the shape, configuration and structural characteristics of the block body which may come within the spirit of this invention and all such changes and modifications coming within the scope of the appended claims are embraced thereby.

I claim:

1. A lightweight preformed environment resistant dimensionally stable rigid modular display block adapted for use with like blocks for exhibiting sundry products and adapted to be arranged for different display conditions, comprising the combination of:

a homogeneous one-piece seamless polyhedral rigid hollow block body of plastic material having smooth, mar and soil resistant exterior surfaces, said body having side walls with top edges lying in a plane, a bottom wall, a top wall spaced below said plane and having peripheral portions uniformly spaced interiorly of said side walls, and recess walls and top edge walls of uniform narrow width joining said top wall and side walls adjacent the peripheral top edges of the side walls, said recess walls, top edge walls, and top portions of said side walls forming an inverted peripheral channel section of material for dimensionally rigidifying a top upstanding peripheral wall portion which extends continuously around the periphery of the block body and which defines a recess pocket of selected depth for containing objects to be displayed;

said bottom wall having an exterior virtually planar surface;

each of said side walls in cross section having a slightly concave configuration for stiffening said block body;

and means including holes formed in peripheral top edge walls and means including corresponding projection on said bottom wall to releasably interlock one block body with at least a portion of another like block body.

2. A lightweight preformed environment resistant dimensionally stable rigid modular display block adapted for use with like blocks for exhibiting sundry products and adapted to be arranged for different display conditions, comprising the combination of:

a homogeneous one-piece seamless polyhedral rigid hollow block body of plastic material having smooth, mar and soil resistant exterior surfaces, said body having side walls with top edges lying in a plane, a bottom wall, a top wall spaced below said plane and having peripheral portions uniformly spaced interiorly of said side walls, and recess walls and top edge walls of uniform narrow width joining said top wall and side walls adjacent the peripheral top edges of the side walls, said recess walls, top edge walls, and top portions of said side walls forming an inverted peripheral channel section of material for dimensionally rigidifying a top upstanding peripheral wall portion which extends continuously around the periphery of the block body and which defines a recess pocket of selected depth for containing objects to be displayed;

said bottom wall having an exterior virtually planar surface;

each of said side walls in cross section having a slightly concave configuration for stiffening said block body;

and means including holes formed in peripheral top edge walls and means including corresponding projection on said bottom wall to releasably interlock one block body with at least a portion of another like block body;

each side wall concave configuration including a rectangular center wall portion and trapezoidal wall portions extending from said rectangular portion in planes inclined to the plane of the rectangular portion.

* * * * *